US006897760B2

(12) United States Patent
Kawata et al.

(10) Patent No.: US 6,897,760 B2
(45) Date of Patent: May 24, 2005

(54) CIRCUIT BREAKER

(75) Inventors: Hisao Kawata, Saitama (JP); Isamu Ohshima, Kanagawa (JP); Yoshimi Jumonji, Saitama (JP); Katsunori Kuboyama, Saitama (JP); Tatsunori Takahashi, Tokyo (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 10/642,492

(22) Filed: Aug. 18, 2003

(65) Prior Publication Data

US 2004/0056750 A1 Mar. 25, 2004

(30) Foreign Application Priority Data

Sep. 9, 2002 (JP) ..... 2002-262666

(51) Int. Cl.[7] ..... H01H 37/02; H01H 73/06

(52) U.S. Cl. ..... 337/328; 337/110; 200/306

(58) Field of Search ..... 337/37, 110, 272–282, 337/203, 249, 250, 3; 200/10, 306; 335/201; 361/2, 12, 14, 134

(56) References Cited

U.S. PATENT DOCUMENTS 3,780,249 A * 12/1973 Harper ..... 200/302.3
4,672,157 A * 6/1987 Neel et al. ..... 218/150
5,313,031 A * 5/1994 Takahashi et al. ..... 200/275
5,753,878 A * 5/1998 Doughty et al. ..... 218/157
5,878,905 A * 3/1999 Gronbach et al. ..... 220/203.01
6,002,313 A * 12/1999 Mrenna et al. ..... 335/202
6,198,063 B1 * 3/2001 Kramer ..... 218/157
6,388,867 B1 * 5/2002 Rakus et al. ..... 361/605

FOREIGN PATENT DOCUMENTS

| | | | |
|---|---|---|---|
| DE | 85 31 352.1 | 2/1986 | |
| EP | 0 964 420 A2 | 12/1999 | |
| JP | 6-68771 | 3/1991 | |
| JP | 3-129628 | 6/1991 | |
| JP | 06111706 A * | 4/1994 | ..... H01H/73/06 |
| JP | 2000-231869 | 8/2000 | |
| JP | 2002-299050 | 10/2000 | |

* cited by examiner

*Primary Examiner*—Anatoly Vortman
(74) *Attorney, Agent, or Firm*—Manabu Kanesaka

(57) ABSTRACT

A circuit breaker includes a rectangular box-shaped intermediate housing and lower housing; a power supply side fixed contact and a load side fixed contact disposed in the intermediate housing and facing each other; and a movable contact housed in the lower housing for bridging the power supply side fixed contact and the load side fixed contact. The lower housing has arc gas emission holes formed in front and rear walls thereof, and is connected to a lower part of the intermediate housing via an engagement part such that the lower housing covers the lower part of the intermediate housing. A thin wall portion is formed in each of the front and rear walls to eject arc gas by bending.

4 Claims, 4 Drawing Sheets

Fig. 3(A)
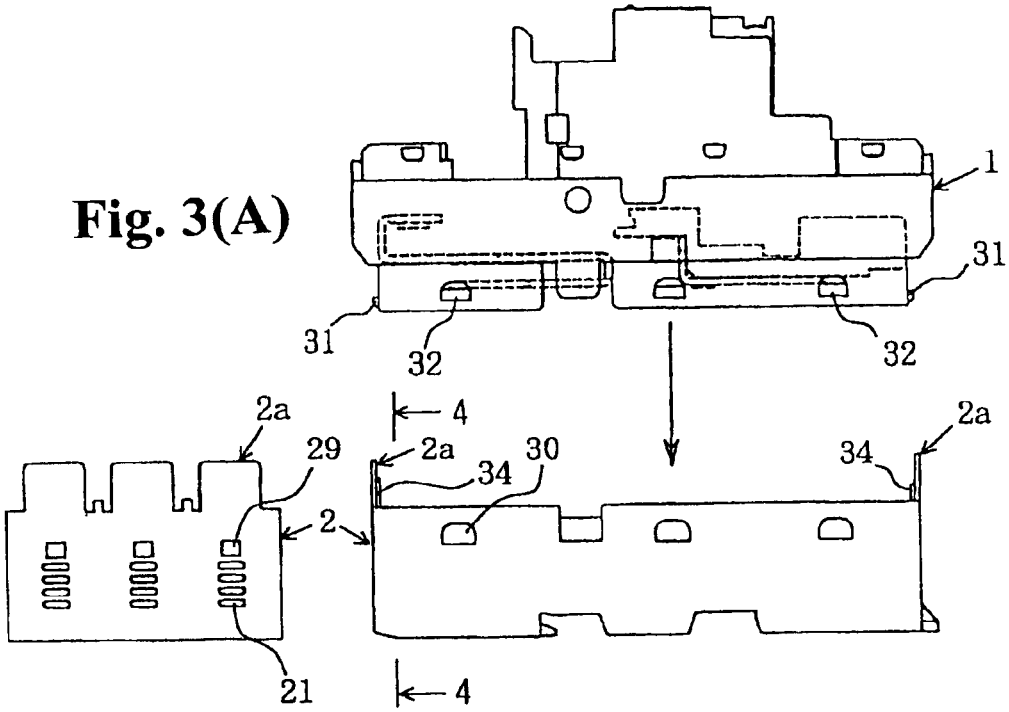
Fig. 3(C) Fig. 3(B)
Fig. 4
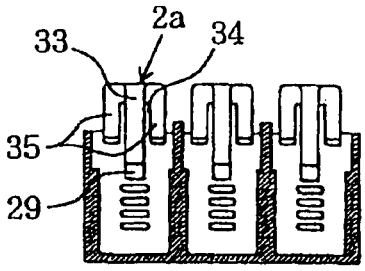

CIRCUIT BREAKER

BACKGROUND OF THE INVENTION AND RELATED ART STATEMENT

The present invention relates to a circuit breaker that serves as a breaker or a switching device for protecting a low-voltage indoor electric line or equipment from over-current. The circuit breaker has a function of opening and closing an electric line manually and tripping the electric line upon detection of the over-current.

A circuit breaker of this type has been disclosed in, for example, Japanese Patent Publication (Kokai) No. 2000-231869. A configuration of the circuit breaker will be explained with reference to FIG. 6. The circuit breaker shown in FIG. 6 is comprised of a molded case including an intermediate housing 1, a lower housing 2 connected to a lower part of the intermediate housing 1, and an upper cover (not shown) fitted to an upper part of the intermediate housing 1. Both the intermediate housing 1 and the lower housing 2 are formed in a rectangular box shape with a bottom. The lower housing 2 is connected to the lower part of the intermediate housing 1 via an engagement part (not shown) such that the lower housing 2 covers the lower part of the intermediate housing 1.

A left side in FIG. 6 is a power supply side, and a right side in FIG. 6 is a load side. Power supply side fixed contacts 3 and load side fixed contacts 4 are disposed at the bottom of the intermediate housing 1 such that they face each other in the longitudinal direction.

A power supply side terminal 5 is formed in a bent shape integrated with the power supply side fixed contact 3, which is fitted into the intermediate housing 1 from the left side in FIG. 6. The load side fixed contact 4 is fitted into a bimetal holder 6 made of an insulating material, and the bimetal holder 6 is fitted into the intermediate housing 1 from the right side in FIG. 6. In FIG. 6, reference numeral 7 denotes a time delay tripping mechanism having a bimetal 8 and a heater 9 wound around the bimetal 8. The bimetal 8 is supported in an upright position in the bimetal holder 6 via a bimetal support 10 made of a conductor. One end of the heater 9 is joined to an upper end of the bimetal 8, and the other end thereof is joined to the load side fixed contact 4.

Further, reference numeral 11 denotes an instantaneous tripping mechanism comprised of a plunger 14 capable of sliding up and down in a coil 13 disposed at an inside of a yoke 12. The instantaneous tripping mechanism is supported in an upright position in the intermediate housing 1 via the yoke 12. One end of the coil 13 is joined to the bimetal support 10, and the other end thereof is joined to the load side terminal 16 held in the bimetal holder 6 via a relay conductor 15.

A movable contact 17, which bridges the power supply side fixed contact 3 and the load side fixed contact 4, is housed in the lower housing 2. In the state shown in FIG. 6, the movable contact 17 is pressed against the power supply side fixed contact 3 and the load side fixed contact 4 to close an electric line by a contact spring 18 comprised of a compression spring inserted between the movable contact 17 and the bottom of the lower housing 2. The movable contact 17 is held in a movable contact holder 19 made of an insulating material, and the movable contact holder 19 is guided into the lower housing 2 to be slidable up and down. A fixed contact and a movable contact are joined at a contact portion between the fixed contact 3 and the movable contact 17, and a contact portion between the fixed contact 4 and the movable contact 17, respectively.

Extinguish chambers 20 are respectively provided at front and rear of the movable contact 17. Arc gas emission holes 21 each formed of several small holes, through which arc gas generated upon breaking of current flows out, are formed in front and rear walls of the lower housing 2, which are opposed to the respective extinguish chambers 20. Tongue-shaped projections 2*a* are formed in an upright position in respective upper parts of the front and rear walls of the lower housing 2. The power supply side fixed contact 3 and the bimetal holder 6 holding the load side fixed contact 4 are pressed by the projections 2*a* in the longitudinal direction so that they do not fall out.

A switching mechanism 23 is disposed in the intermediate housing 1. The switching mechanism 23 is comprised of a switching lever 26 that rotates around a shaft 25 in response to ON/OFF actions of a switching handle 24. When the switching handle 24 is in the ON state as shown in FIG. 6, the switching lever 26 is held in the state as shown in FIG. 6, and a main spring (not shown) comprised of a torsion spring attached to the shaft 25 holds elastic energy. When the switching handle 24 is brought into the OFF state from the ON state, the switching lever 26 rotates clockwise to push down the movable contact 17 via the movable contact holder 19. As a result, the movable contact 17 opens the electric line between the fixed contacts 3 and 4.

In the ON state as shown in FIG. 6, the current flows in a conductive path from the power supply side terminal 5 to a load side terminal 16 via the power supply side fixed contact 3, movable contact 17, load side fixed contact 4, heater 9, bimetal 8, bimetal support 10, coil 13, and relay conductor 15 in this order. When the load current flowing in this conductive path is overloaded, the heater 9 heats the bimetal 8 to deform and release the locked switching mechanism 23 via a shifter 27 upon the lapse of time according to a value of the current. As a result, the switching lever 26 is driven to rotate clockwise by the energy applied by the above-mentioned main spring, so that the movable contact 17 is opened to cut the current (tripping action).

When the large current such as short-circuit current flows in the above-mentioned conductive path, an electromagnetic repulsive force between the fixed contacts 3 and 4 and the movable contact 17 surpasses the force of the contact spring 18, so that the movable contact 17 is instantaneously driven in a direction to be released. At the same time, the plunger 14 is pulled by a magnetic field generated by the coil 13, and causes a push rod 28 to project downward to hold the movable contact 17 in the open position. Further, the plunger 14 releases the locked switching mechanism 23 via a trip board (not shown). As a result, just as in the case where the bimetal 8 is deformed, the switching lever 25 pushes down the movable contact holder 19, so that the movable contact 17 is held in the open position even after the electromagnetic force disappears.

In such a tripping action by the flow of the large current, high-voltage arc gas is generated inside the lower housing 2 due to an arc generated between the fixed contact and the movable contact.

The above-mentioned arc gas passes through the extinguish chambers 20 to reach the walls of the lower housing 2 on the power supply side and the load side, and then is emitted through the gas emission holes 21 as indicated by arrows in FIG. 7. When the large current is cut or broken, the lower housing 2 is deformed due to an increase in the internal pressure thereof caused by the arc gas. For this reason, the lower case 2 covering the intermediate case 1 may be disengaged from the intermediate case 1.

It is therefore an object of the present invention to prevent the lower housing 2 from detaching from the intermediate housing 1 due to an increase in the internal pressure when the large current is broken.

Further objects and advantages of the invention will be apparent from the following description of the invention.

SUMMARY OF THE INVENTION

To attain the above objects, according to the present invention, a circuit breaker comprises a rectangular box-shaped intermediate housing and a lower housing; a power supply side fixed contact and a load side fixed contact disposed in the intermediate housing and facing each other; and a movable contact housed in the lower housing for bridging the power supply side fixed contact and the load side fixed contact. The lower housing has arc gas emission holes formed in front and rear walls thereof, and is connected to a lower part of the intermediate housing via an engagement part such that the lower housing covers the lower part of the intermediate housing. The front and rear walls of the lower housing press the power supply side fixed contact and the load side fixed contact from front and rear sides. A thin portion, or a thin part, is formed at a part of each of the front and rear walls of the lower housing that presses the power supply side fixed contact and the load side fixed contact. When current is broken and an internal pressure of the lower housing increases due to the arc gas, the thin parts of the front and rear walls are deformed outwardly by the internal pressure, so that the arc gas easily escapes from the lower housing to outside.

In the present invention, the thin portion part of the lower housing is deformed to allow the arc gas to escape easily, so that it is possible to suppress the internal pressure from increasing. As a result, the engagement part of the lower housing does not deform greatly, and thus the lower housing is prevented from being disengaged from the intermediate housing.

In the invention, it is preferred that the thin part is formed around a part of the lower housing where the power supply side fixed contact and the load side fixed contact are pressed. Accordingly, it is possible to tightly press the fixed contacts with a thick part at an inside of the thin part even though the thin part is formed.

BRIEF DESCRIPTION OF THE DRAWINGS

FIGS. 3(A)–3(C) show an intermediate housing and a lower housing of the circuit breaker shown in FIG. 1, wherein FIG. 3(A) is a side view of the intermediate housing, FIG. 3(B) is a side view of the lower housing, and FIG. 3(C) is a left front view of the lower housing;

FIG. 4 is a sectional view taken along line 4—4 in FIG. 3(B);

DETAILED DESCRIPTION OF PREFERRED EMBODIMENTS

Figure 1:
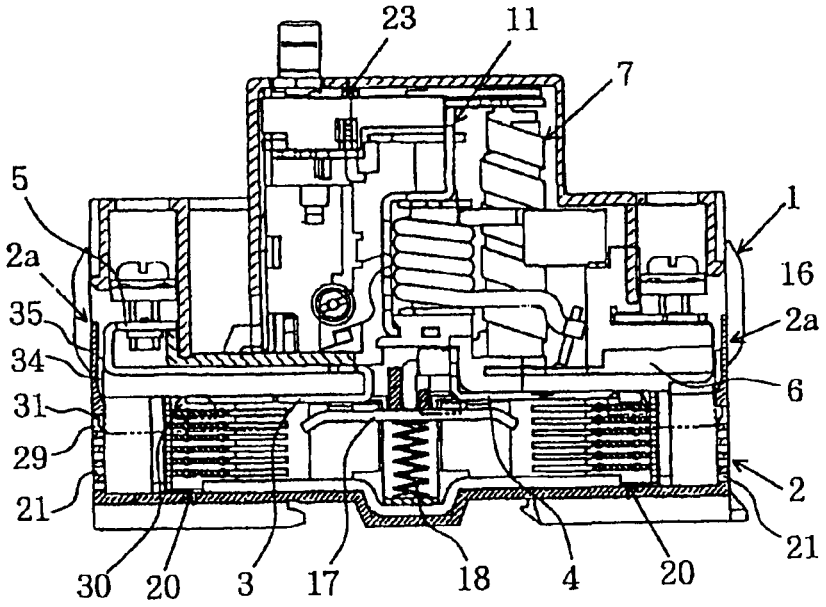
FIG. 1 is a longitudinal sectional view showing a circuit breaker according to an embodiment of the present invention.
Figure 2:
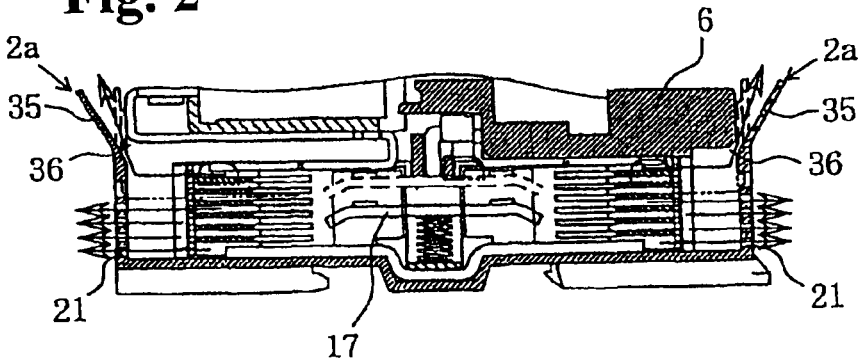
FIG. 2 is a longitudinal sectional view showing an essential part of the circuit breaker when arc gas is emitted.
Figure 5:
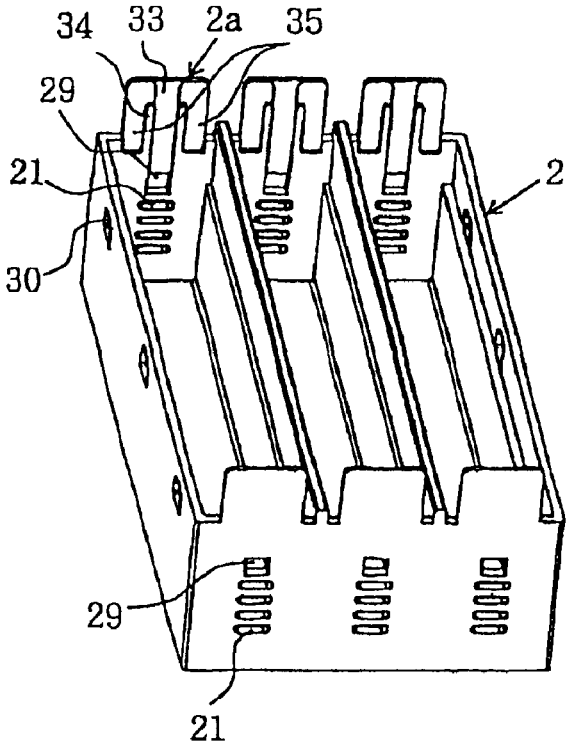
FIG. 5 is a perspective view of the intermediate housing of the circuit breaker shown in FIG. 1.
Figure 6:
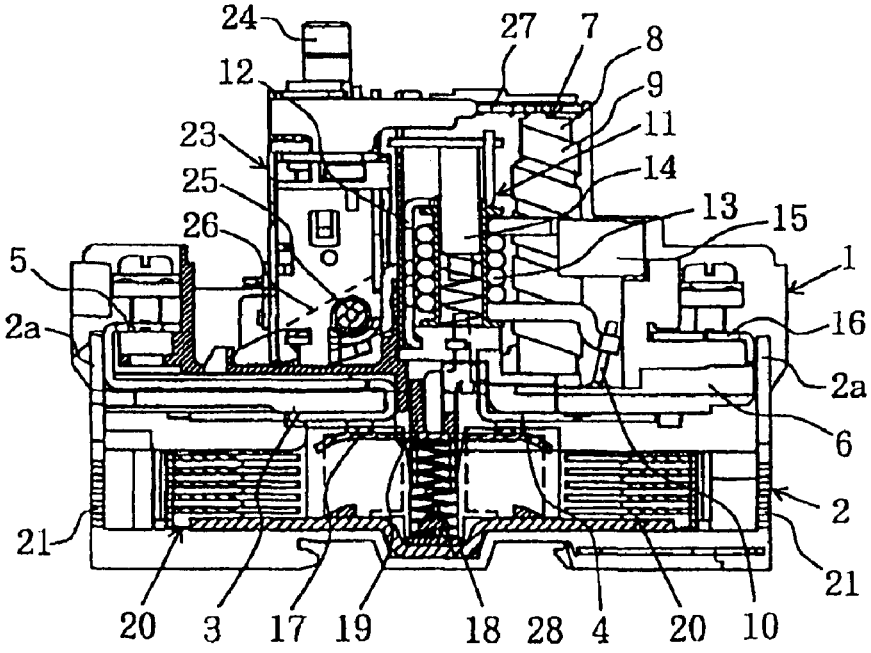
Fig. 6 Prior Art
FIG. 6 is a longitudinal sectional view showing a conventional circuit breaker.
Figure 7:
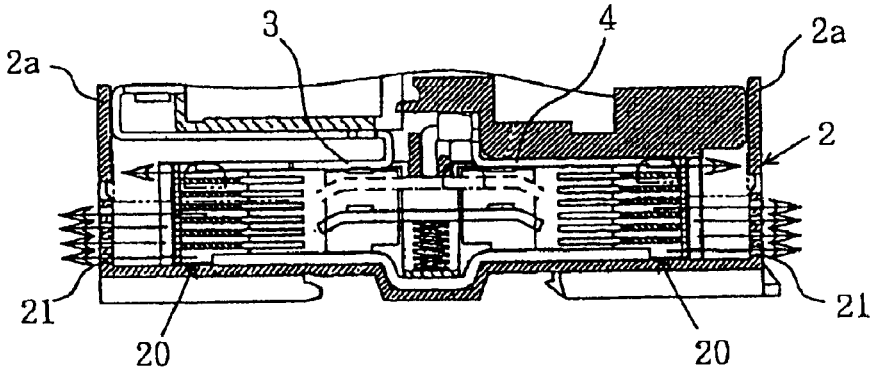
Fig. 7 Prior Art
FIG. 7 is a longitudinal sectional view showing an essential part of the conventional circuit breaker shown in FIG. 6 when arc gas is emitted.

Hereunder, embodiments of the present invention will be described in detail with reference to the accompanying drawings. FIG. 1 is a longitudinal sectional view showing a three-phase circuit breaker in an ON state, FIG. 2 is a longitudinal sectional view showing a state that a lower housing is deformed when large current is cut or broken, FIGS. 3(A)–3(C) are side views showing an intermediate housing and the lower housing, FIG. 4 is a sectional view taken along line 4—4 in FIG. 3(B), and FIG. 5 is a perspective view showing the lower housing. In the drawings, elements and parts substantially identical to those in the conventional device are designated by the same reference numerals, and descriptions thereof are omitted.

As shown in FIG. 5, a rectangular box-shaped lower housing 2 is divided into three portions by partition walls. Rectangular engagement holes 29 constitute engagement parts to be engaged with the intermediate housing 1, and are formed in the respective front and rear walls such that the holes 29 are located above gas exhaust holes 21. Further, engagement holes 30 with a substantially semicircular shape are formed at three locations in each of right and left sidewalls.

As shown in FIG. 3(A), engagement pawls 31 and 32 having an identical shape protrude from the front and rear walls and the right and left side walls at locations corresponding to the engagement holes 29 and 30 of the lower housing 2. An inclined surface is formed in a lower half part of each of the pawls 31 and 32. When the intermediate housing 1 is pushed in a direction indicated by an arrow in FIG. 3(A), the engagement holes 29 and 30 engage the engagement pawls 31 and 32 by snap fitting due to elastic deformation of the intermediate housing 1 and the lower housing 2, so that the lower housing 2 is connected to the intermediate housing 1.

As shown in FIGS. 4 and 5, a guide groove 33 is formed in each of the front and rear walls of the lower housing 2 and extends from an upper end of a rectangular projection 2*a* up to the engagement hole 29, so that the engagement pawl 31 is guided in the guide groove 33 to reach the engagement hole 29 when the lower housing 2 is connected to the intermediate housing 1 as mentioned above. At the projection 2*a* of the lower housing 2, a thin part 35 is formed around a lower central part 34. The thin part 35 has a wall thickness greater than that of the guide groove 33 and smaller than that of the lower central part 34.

In the circuit breaker shown in FIG. 1 provided with the intermediate housing 1 and the lower housing 2 shown in FIGS. 3(A)–4, the projections 2*a* formed in the front and rear walls of the lower housing 2 press the power supply side fixed contacts 3 at the lower central parts 34 via the terminals 5, and press the load side fixed contacts 4 via the bimetal holders 6 so as to prevent the fixed contacts 3 and 4 from falling out.

When large current is cut or broken, arc gas is generated and the internal pressure of the lower housing 2 increases. At this time, as shown in FIG. 2, each of the projections 2*a* of the lower housing 2 is deformed outwardly due to relatively low rigidity of the thin parts 35. Therefore, the arc gas escapes to the outside not only through the gas exhaust holes 21 but also through gaps 36 formed due to the deformation of the projections 2*a*, so that the internal pressure of the lower housing 2 can be suppressed not to increase. As a result, the front and rear walls and the sidewalls of the lower housing 2 with the engagement holes 29 and 30 are deformed in a less extent, so that the intermediate housing 1 is not disengaged from the lower housing 2.

As described above, according to the present invention, the thin part is provided at a part of the lower housing that presses the fixed contacts fitted in the intermediate housing. When the large current is broken and the internal pressure increases, the parts of the lower housing deform outwardly to escape the arc gas to the outside. Therefore, it is possible to prevent the lower housing from deforming due to the increase in the internal pressure when the large current is cut or broken, and prevent the lower housing from detaching from the intermediate housing. Further, the thin parts can be formed when the lower housing is molded, thereby reducing a cost.

While the invention has been explained with reference to the specific embodiments of the invention, the explanation is illustrative and the invention is limited only by the appended claims.

What is claimed is:

1. A circuit breaker, comprising:

a power supply side fixed contact and a load side fixed contact facing the power supply side fixed contact, a movable contact for bridging the power supply side fixed contact and the load side fixed contact, and a main housing including an intermediate housing with a lower portion in which said power supply side fixed contact and load side fixed contact are disposed, and a lower housing in which said movable contact is disposed, said lower housing being fitted in the intermediate housing for covering the lower portion thereof and having front and rear walls with thin wall portions and arc gas emission holes, each of said front and rear walls having a center portion and a guide wall in the center portion, said thin wall portions being located on two sides of the center portion and having a thickness greater than that of the guide wall and less than that of the center portion so that when the electrical current is broken and arc gas is generated in the main housing, the thin wall portions bend outwardly to allow the arc gas to flow out through a gap formed by bending the thin wall portions and the arc gas emission holes.

2. A circuit breaker according to claim 1, wherein said intermediate housing and lower housing have engagement parts to engage together.

3. A circuit breaker according to claim 1, wherein said front and rear walls have pressing portions for pressing the power supply side fixed contact and the load side fixed contact from front and rear sides thereof.

4. A circuit breaker according to claim 3, wherein said thin wall portions are formed around the pressing portions.

* * * * *